US005864321A

United States Patent [19]

Paul et al.

[11] Patent Number: 5,864,321

[45] Date of Patent: Jan. 26, 1999

[54] MICROWAVE TERRESTRIAL RADIO WITH DOVETAIL ATTACHMENT AND REFERENCE PLANE

[75] Inventors: Jeffrey A. Paul, Torrance; Roy Wien, Cerritos; Richard P. Mintzlaff, Granada Hills, all of Calif.

[73] Assignee: Raytheon Company, El Segundo, Calif.

[21] Appl. No.: 707,278

[22] Filed: Sep. 3, 1996

[51] Int. Cl.[6] ..... H01Q 3/00; H01Q 1/12

[52] U.S. Cl. ..... 343/757; 343/702; 343/878; 343/891

[58] Field of Search ..... 343/757, 906, 343/702, 891, 758, 759, 763, 765, 878, 880, 882; H01Q 1/24, 3/00, 1/12

[56] References Cited

U.S. PATENT DOCUMENTS 3,956,701 5/1976 James, Jr. et al. ..... 343/881

4,727,598 2/1988 Ehlers ..... 343/702

*Primary Examiner*—Hoanganh T. Le

*Attorney, Agent, or Firm*—Leonard A. Alkov; William C. Schubert; Glenn H. Lenzen, Jr.

[57] ABSTRACT

The radio frequency unit of a millimeter wave terrestrial radio includes a housing with a front face and a back face, a microwave radio frequency transceiver electronics package within the housing, an antenna affixed to the front face of the housing, and appropriate signal connections and feeds. One portion of a dovetail support structure, preferably the male dovetail fitting, is affixed to the back face of the housing. The other portion of the dovetail support structure, preferably the female dovetail fitting, is mounted to a mounting structure. The dovetail support structure allows the radio frequency unit to be readily mounted to and demounted from the mounting structure. A reference plane defined between the radio frequency unit and the mounting structure allows the radio frequency unit to be precisely oriented relative to the mounting structure.

25 Claims, 6 Drawing Sheets

MICROWAVE TERRESTRIAL RADIO WITH DOVETAIL ATTACHMENT AND REFERENCE PLANE

BACKGROUND OF THE INVENTION

This invention relates to microwave radios, and, more particularly, to a radio frequency unit for a microwave radio.

Microwave radio communications are widely used to transfer large amounts of data, such as in earth and space microwave long-distance communications links. They are also of interest for shorter-range, lower-power applications such as the basic voice, video, and data links between, for example, a cellular base station and a central telephone office. In such applications, the microwave transmission distance is typically about ½–5 miles, the microwave signal is at a specific frequency within the range of about 2–94 GHz, and the power output of the microwave transmitter is about 100 milliwatts. Such microwave communications system are generally termed "point-to-point" systems.

Corresponding to the high-power microwave communications systems, a conventional point-to-point system has three basic physical parts: a signal processing unit (SPU), sometimes termed an "indoor" unit having the baseband radio components, a radio frequency (RF) unit (RFU), sometimes termed an "outdoor" unit having the microwave-frequency radio components, and an antenna. Because a microwave feed is required between the components operating at microwave frequency, the radio frequency unit is located within a few feet of the antenna, which ordinarily is mounted outside and aimed at another point-to-point terminal located some distance away. The antenna is typically a parabolic antenna of the cassegrain type. The signal processing unit may be located quite some distance from the radio frequency unit. An ordinary coaxial cable set extends between the signal processing unit and the radio frequency unit, but a microwave coaxial feed is required between the radio frequency unit and the antenna.

As point-to-point systems become more popular, their physical packaging becomes more important. The existing radio frequency units and antennas are bulky, heavy, and, in many cases, difficult to mount, align, and maintain in alignment. With the proliferation of point-to-point systems in large cities, new mounting space on existing masts and elsewhere has become more difficult to find. Installers must hoist the later-installed radio frequency unit and antenna to ever-more-precarious locations in order to establish line-of-sight contact with the remote terminal. The radio frequency unit and the antenna must be mounted in close proximity to each other. Conventional mounting systems for the radio frequency unit and the antenna include arrangements of brackets, guy wires, and turnbuckles. Great care must be taken in the alignment of the antenna with a remote antenna by adjustment of the mounting system. If the antenna must be replaced at a later time, the new antenna must again be aligned.

To overcome these problems, the assignee of the present invention is developing an integrated point-to-point microwave radio frequency unit and antenna, which is much more compact and lighter in weight than conventional systems. However, the problem remains of supporting the integrated unit in a manner so as to make installation and replacement simple and convenient. There is a need for a mounting approach to be used in conjunction with the improved integrated radio frequency unit and antenna, which overcomes these problems. The present invention fulfills this need, and further provides related advantages.

SUMMARY OF THE INVENTION

The present invention provides an integrated point-to-point microwave radio frequency unit/antenna with a convenient support structure. The support structure permits the integrated radio frequency unit/antenna to be quickly and easily mounted to a structure such as a mast by a single person. The support structure holds the integrated radio frequency unit/antenna in a stable fixed orientation after alignment is complete. If at a subsequent time the integrated radio frequency unit/antenna must be replaced, it is easily demounted and replaced by a single person. The support structure ensures that the replacement unit will be aimed at the same remote terminal as the removed unit, an important convenience because the difficultly and cost of re-alignment can be high. The support structure is light in weight and inexpensive.

In accordance with the invention, an integrated point-to-point microwave radio frequency unit/antenna is operable in conjunction with a mounting structure having a mounting structure reference plane surface and a mounting structure support element. The radio frequency unit/antenna comprises a housing having a front face and a back face, with the back face having a housing reference plane surface thereon. A microwave radio frequency transceiver electronics package, with an external connection and an antenna connection, is within the housing. An antenna is affixed to the front face of the housing, and a microwave radio frequency feed communicates between the antenna and the antenna connection of the microwave transceiver electronics package. A housing support element is affixed to the housing. The housing support element and the mounting structure support element are engageable to each other such that the housing reference plane surface is positioned in contact with the mounting structure reference plane surface in a face-to-face relationship.

The abutting references planes provide a means of aligning the radio frequency unit/antenna. Once the support reference plane surface orientation is established during the initial alignment procedure, any subsequently installed radio frequency unit/antenna is installed in an aligned condition.

The support element is preferably a dovetail structure wherein one of the dovetail portions, preferably the male portion, is affixed to the back face of the housing. The other of the dovetail portions, preferably the female portion into which the male portion is slidably received, is affixed to the structure to which the integrated radio frequency unit/antenna is mounted. The two dovetail portions are held in a fixed relationship to each other by any convenient approach, preferably a set screw. A lock may also be provided to prevent the theft of the integrated radio frequency unit/antenna.

The housing is installed by sliding the two portions of the support element together and setting the set screw. The antenna is aimed at a remote terminal by aligning the portion of the support that is affixed to the structure. If at a later time the integrated radio frequency unit/antenna element must be replaced, the set screw is retracted and the dovetail structure is separated by sliding the elements apart. A new integrated radio frequency unit/antenna is installed by sliding the dovetail elements together and setting the set screw. The antenna of the integrated radio frequency unit/antenna is thereby aligned, because the two reference planes are held in a fixed region to each other.

Although this procedure may seem straightforward when described, it must be recalled that the replacement is often performed in a precarious position and under difficult circumstances such as great height above the ground, high wind, and significant exposure of personnel. When considered in light of these conditions, the present approach provides a great advance by reducing the weight that must be carried by the technician, and simplifying the installation, alignment, and replacement procedures as compared with prior approaches.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
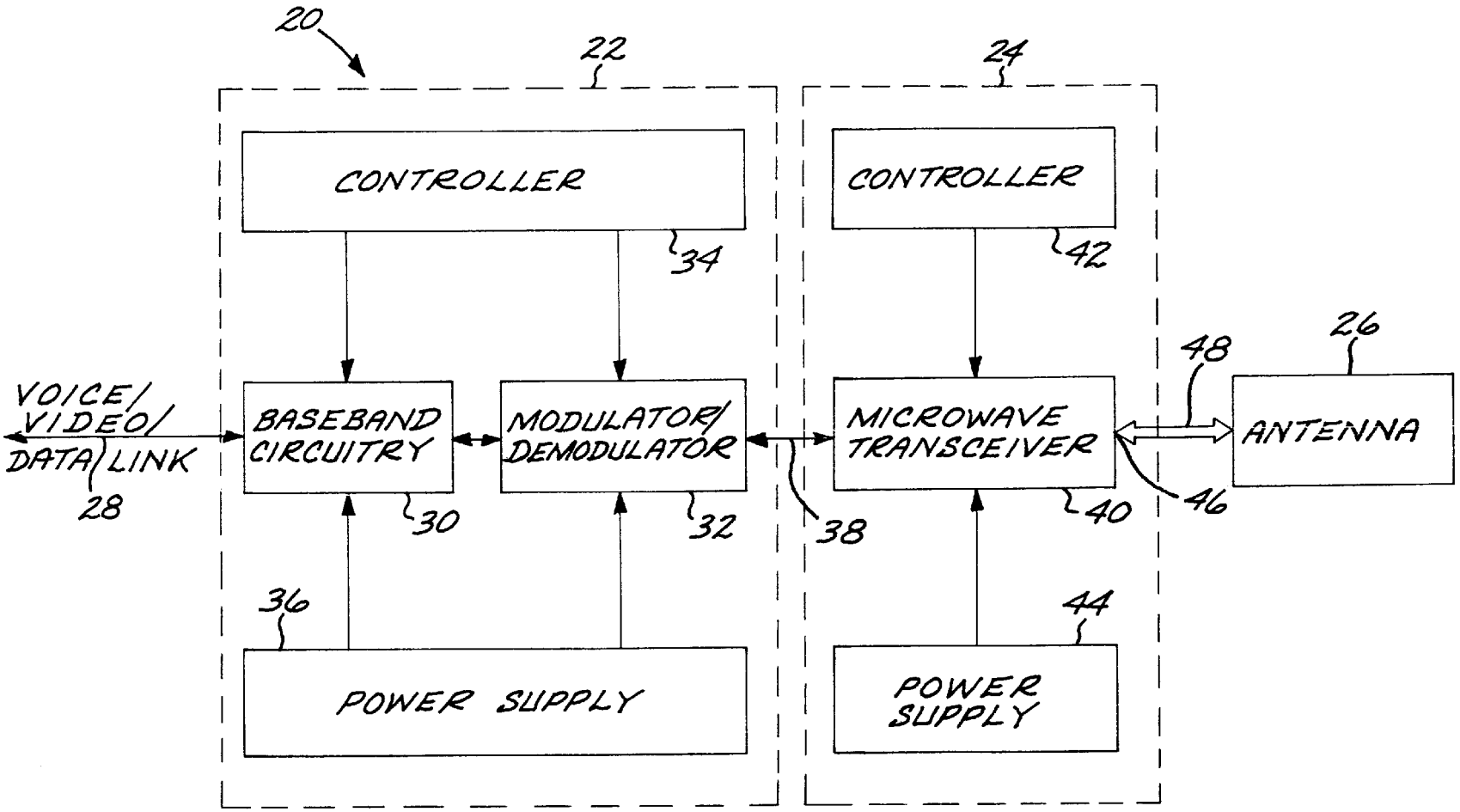
FIG. 1 is a schematic diagram of a microwave radio transmitter and receiver.

FIG. 1 is a schematic diagram of a microwave radio transceiver system 20. The general electronic structure of such systems 20 is known in the art and is described in greater detail, for example, in "RF Components for PCS Base Stations", published by Strategies Unlimited, 1996. The present invention resides not in a change to this basic, known electronic approach, but in its packaging and mounting in a highly advantageous form.

The system 20 includes a signal processing unit 22 (sometimes termed an "indoor unit") that processes baseband signals, a radio frequency unit 24 (sometimes termed an "outdoor unit") that processes microwave signals, and a microwave antenna 26. The signal processing unit has an input/output 28 of voice, video, and/or data link information. This input/output 28 is processed through baseband circuitry 30 and a modulator/demodulator 32. A controller 34 and a power supply 36 are also provided in the signal processing unit 22. The signal processing unit 22 communicates with the radio frequency unit 24 at low frequencies through a conventional coaxial signal cable 38.

The radio frequency unit 24 includes a microwave transceiver 40 that operates in a selected microwave frequency band within the broad band extending from about 2 to about 94 GHz (Gigahertz) by converting the low-frequency signal of the signal processing unit 22. A controller 42 and a power supply 44 are provided in the radio frequency unit 24. The microwave transceiver 40 has an antenna connection 46 into which a microwave radio frequency feed 48 is connected to provide a signal to the antenna 26, or to receive a signal from the antenna. The microwave radio frequency feed 48 may be a coaxial cable or waveguide which cannot be more than a few feet long without suffering substantial signal attenuation.

Figure 2:
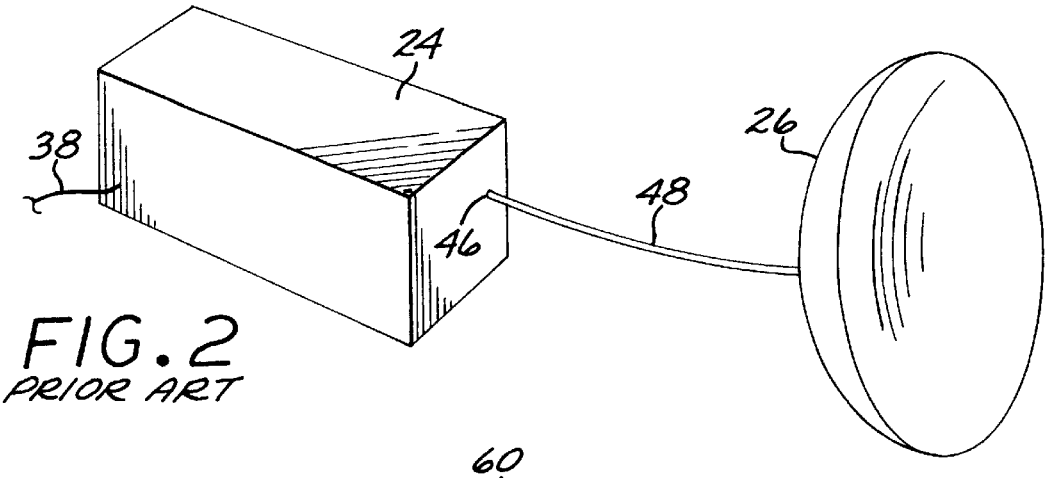
FIG. 2 PRIOR ART
FIG. 2 is a perspective view of a conventional microwave radio frequency unit and antenna.

FIG. 2 depicts the implementation of a conventional prior radio frequency unit 24 and antenna 26, connected by the microwave feed 48, which utilizes the electronics approach of FIG. 1. The radio frequency unit 24 typically has measurements of 12 inches by 12 inches by 12 inches and weighs about 35 pounds. The antenna 26 is a cassegrain parabolic antenna having a dish diameter of about 12 inches or more and a weight of about 15 pounds. Both components must be mounted at a location such that the antenna 26 may be aimed at a similar but remotely located terminal. The installer must find a way to mount the antenna 26 so that it is aligned with the antenna of the remote unit, and to mount the radio frequency unit 24 so that it is secure yet is within the range permitted by the length of the microwave feed 48. Other versions of the prior approach of FIG. 2 are known wherein the parabolic antenna is affixed directly to the radio frequency unit, but such a combined approach remains awkward to handle and heavy.

Figure 3A:
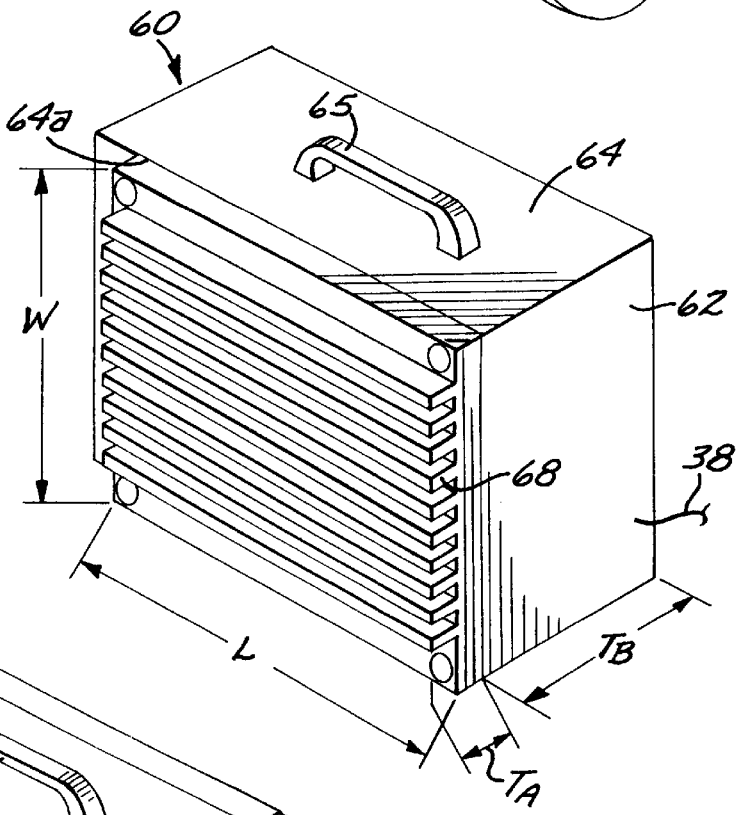
FIG. 3A is a front perspective view of an integrated radio frequency unit/antenna according to the invention.
Figure 3B:
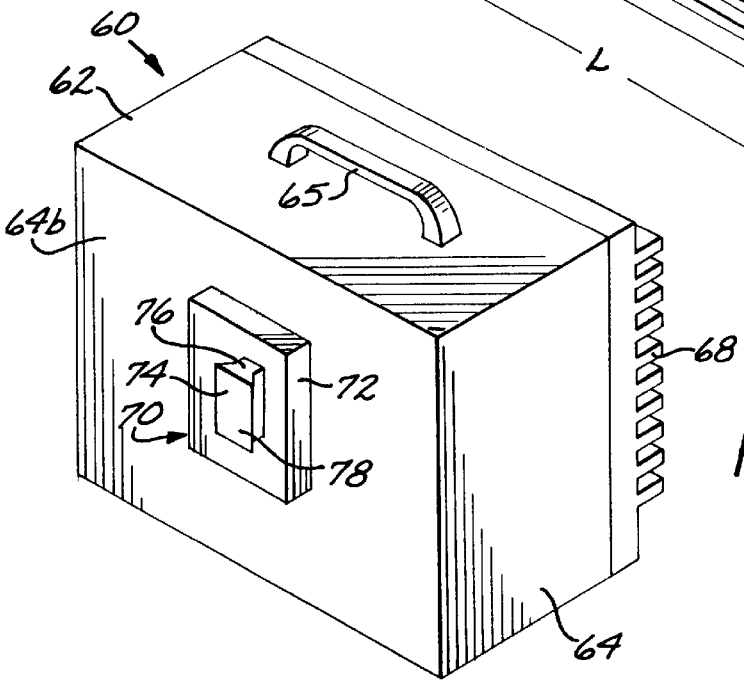
FIG. 3B is a back perspective view of the integrated radio frequency unit/antenna of FIG. 3A.

FIGS. 3A and 3B show an integrated radio frequency unit/antenna of the invention in front and back perspective views. This apparatus uses the general electronics approach of FIG. 1, but with a different architecture and antenna that offer important advantages. An integrated radio frequency unit/antenna 60 includes a housing 62 having an exterior wall 64 with a front face 64*a* and a back face 64*b*. A handle 65, which may be integral or detachable, extends from the housing 62 and permits the radio frequency unit/antenna 60 to be easily carried. A microwave radio frequency transceiver electronics package (not visible) is fixed within the housing 62. The electronics package includes the microwave transceiver 40, the controller 42, and the power supply 44. Part of the exterior wall 64, in this case the front face 64*a*, includes an integral flat antenna 68. The flat antenna 68 may be formed separately and attached to the wall 64, as illustrated, or it may be formed integrally as part of the wall itself. That portion of the wall 64 which is not the antenna 68 may be made of any operable material, such as a metal or a plastic. A radome (not shown) in the form of a plastic sheet may be mounted over the face of the flat antenna 68 to protect it. The flat antenna 68 is preferably a continuous transverse stub (CTS) antenna. The CTS microwave antenna is known in the art and is described, for example, in U.S. Pat. 5,266,961, whose disclosure is incorporated by reference.

The integrated radio frequency unit/antenna 60 has an antenna connection and a microwave radio frequency feed cable extending from the antenna connection to the back side of the flat antenna 68. The radio frequency feed is at most 1–2 inches long and contained entirely within the housing 62, and accordingly is not visible in FIGS. 3A and 3B. There is very little microwave attenuation as the signal passes through this short feed. The installer is only required to position and fix in place the single integrated radio frequency unit/antenna 60, and is not concerned with moving and positioning two units in a compatible manner.

FIG. 3B illustrates a portion of a support element 70 by which the housing 64 and attached components may be mounted to a mounting structure. The support element 70 includes a raised portion of the housing 64 in the form of a hat section 72 that extends rearwardly from the back face 64*b*. Fixed to the hat section 72 and extending further rearwardly therefrom is a first portion of the support element 70, illustrated as a preferred male dovetail fitting 74. The male dovetail fitting 74 includes a relatively narrow base 76 and a laterally enlarged tenon 78.

Figure 4:
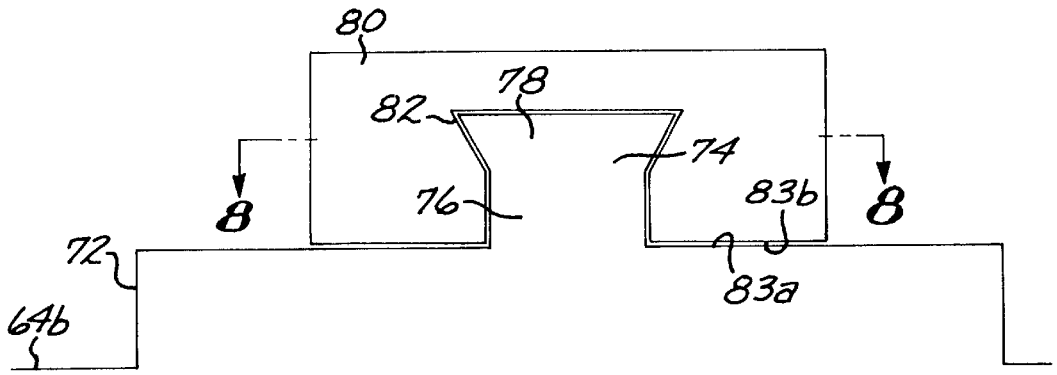
FIG. 4 is an enlarged schematic sectional elevational view of a detail of the support structure of the integrated radio frequency unit/antenna of FIG. 3B, taken generally at a location along lines 4—4.

FIG. 4 illustrates the support element 70 in greater detail, with both the first portion, as previously discussed, and a second portion shown. The preferred second portion is a female dovetail fitting 80 having a mortise 82 that slidably receives therein the tenon 78 of the male dovetail fitting 74. (In FIGS. 4–8, the clearance between the tenon and the mortise is exaggerated so as to be visible.) The female dovetail fitting 80 is affixed to a structure (not shown here, but which will be discussed in relation to FIG. 9). Equivalently, the female dovetail fitting may be affixed to the housing and the male dovetail fitting affixed to the structure.

The hat section 72 has a rearwardly facing face that defines a housing reference plane surface 83*a*. The female dovetail fitting 80 has a forwardly facing face that defines a mounting structure reference plane surface 83*b*. When the support elements in the form of the male dovetail fitting 74 and the female dovetail fitting 80 are slidably engaged to each other, the reference plane surfaces 83*a* and 83*b* are in a facing relationship to each other. When the engagement between the support elements is complete, the two reference plane surfaces 83*a* and 83*b* are drawn into a face-to-face contact.

The contacting between the two plane surfaces reliably and reproducibly establishes the angular orientation of the radio frequency unit/antenna 60. The dovetail or other type of support element between the radio frequency unit/antenna 60 and the mounting structure does not inherently yield a closely reproducible angular orientation, due to the tolerances necessary when two elements must be capable of mounting together in adverse conditions. That is, if the dovetail portions have sufficiently large tolerances to make their sliding together and apart sufficiently easy to be useful, the resulting angular tolerances are unacceptably large. For example, the present radio frequency unit/antenna 60 is to be reproducibly alignable to within ¼°. The tolerances inherent in the dovetail support element do not, in themselves, permit this degree of reproducibility.

The contacting of the reference plane surfaces 83*a* and 83*b* establishes a highly precise and repeatable angular orientation for the radio frequency unit/antenna 60. In the preferred embodiment, the length of contacting of the surfaces 83*a* and 83*b* is about 4 inches. Controlling the angular orientation of the surfaces 83*a* and 83*b* to within limits of about 0.015 inches over that 4-inch distance during manufacturing results in the required precision and repeatability for the orientation between the two reference plane surfaces 83*a* and 83*b*. Placing the housing reference plane 83*a* on the hat section 72 positions it further away from the centerline of the radio frequency unit/antenna 60, permitting greater tolerances in the orientation and planarity of the reference plane surfaces 83*a* and 83*b*. This care in achieving the largest possible manufacturing tolerances, while still ensuring that the angularity specification is met, is important in view of the manner in which the radio frequency unit/antenna 60 is used, to be discussed subsequently. If an already-aligned radio frequency unit/antenna is removed and replaced, the replacement unit will be aligned to within the ¼° specification if its reference plane surface 83*a* meets the plane-orientation tolerance discussed above. The larger that tolerance is, the easier it is to satisfy in commercial-scale manufacturing operations.

Figure 5:
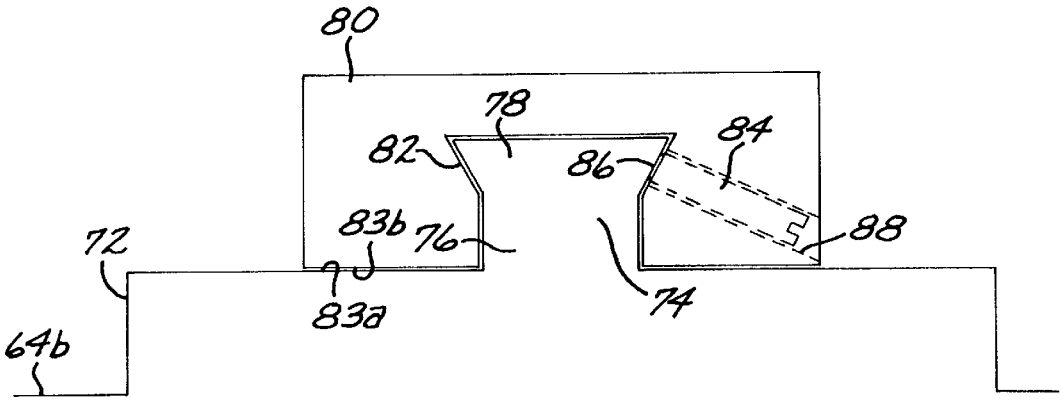
FIG. 5 is a view like that of FIG. 4, but at a different vertical position illustrating a set screw to hold the male and female dovetail elements in a fixed relation.
Figure 6:
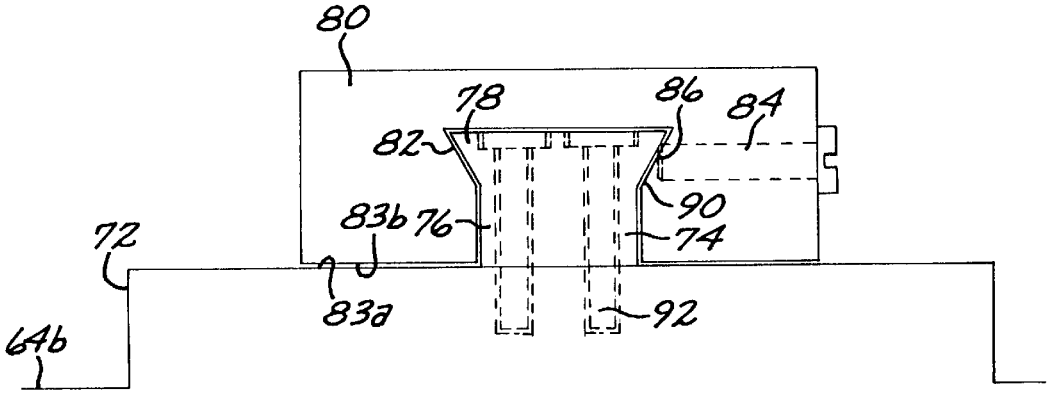
FIG. 6 is a view like that of FIG. 5, illustrating another form of the set screw arrangement.

After the male dovetail fitting 74 is slidably engaged to the female dovetail fitting 80, the relative positions of the two are fixed. The preferred approach to fixing the relative positions, as shown in FIGS. 5 and 6, is with a set screw 84 extending through a threaded bore in the female dovetail fitting 80. One or more set screws 84 may be provided as needed. When the set screw 84 is tightened, an end 86 of the set screw abuts the tenon 78 and fixes the position of the fittings 74 and 80. The set screw 84 is loosened and retracted to permit the two fittings 74 and 80 to be disengaged. The set screw 84 may be positioned to lie roughly perpendicular to the side face of the tenon with the head of the set screw 84 in a recess 88 in the female dovetail fitting 80, as shown in FIG. 5. It may instead be positioned to lie parallel to the top of the tenon with its head against the side of the female dovetail fitting 80, as shown in FIG. 6. The end 86 of the screw 84 may abut directly against the side of the tenon 78 when tightened, as shown in FIG. 5, or it may abut against a vane 90 that distributes the axial loading of the set screw 84 over the side of the tenon, as shown in FIG. 6. Either approach of FIGS. 5 and 6 may be used with or without the vane.

In the embodiments of FIGS. 4 and 5, the base 76 of the male dovetail fitting is permanently affixed to the hat section 72 and thence to the back face 64*b* of the housing 62. In another embodiment illustrated in FIG. 6, the base 76 may be removably affixed to the back face 64*b* with machine screws 92 extending through the base 76 and tenon 78, or other operable fastener.

Figure 7:
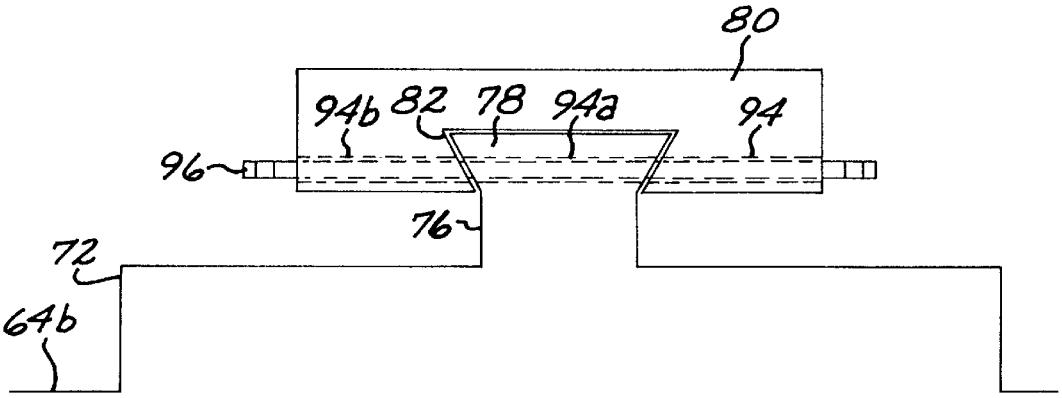
FIG. 7 is a view like that of FIG. 4, but at yet a different vertical position illustrating one form of a lock.

The set screw 84 fixes the positions of the two fittings 74 and 80 relative to each other. The two fittings 74 and 80 may also be locked together to prevent the theft of the integrated outdoor unit/antenna 60. In one approach, as illustrated in FIG. 7, bores 94*a* and 94*b* extend through the male dovetail fitting 74 and the female dovetail fitting 80, respectively, in an axially aligned relationship, forming a continuous bore 94 therethrough. The bore 94 is positioned at a different location along the length of the fittings 74 and 80 than the locking screw 84, so that there is no interference between the two. A locking element 96, which may be, for example, a pin with locks at both end, a strap that whose ends lock together, or an elongated padlock, is placed through the bore 94 to lock the fittings 74 and 80 together.

Figure 8:
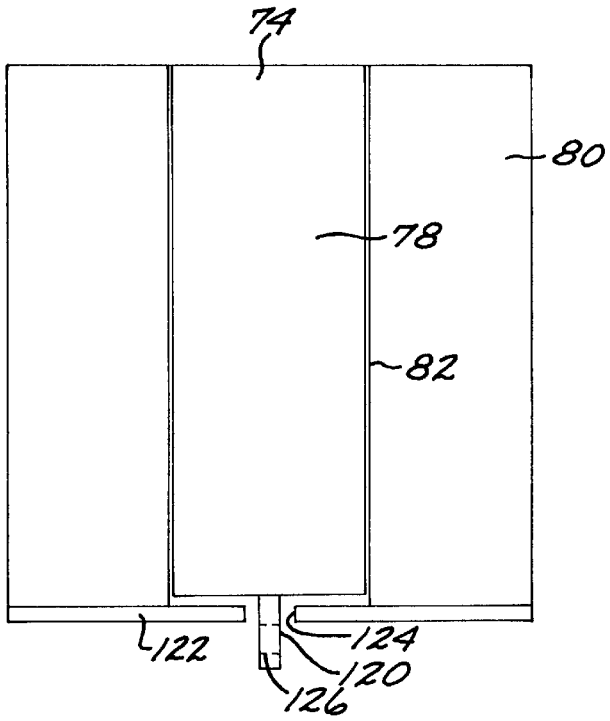
FIG. 8 is a sectional view taken along lines 8—8 of FIG. 4, illustrating another locking approach.

FIG. 8 illustrates another locking approach. An ear 120 is attached to one end of the tenon 78, and a plate 122 with an aperture 124 therethrough is attached to the corresponding end of the female dovetail fitting 80. The plate 122 has an aperture 124 therethrough, and the ear 120 fits through the aperture 124 when the dovetail fittings 74 and 80 are engaged to each other in the installed position. The ear 120 has a bore 126 therethrough, which receives a padlock or other locking element therethrough (not shown). The two dovetail fittings 74 and 80 are thereby easily locked to each other with a standard padlock.

Figure 9:
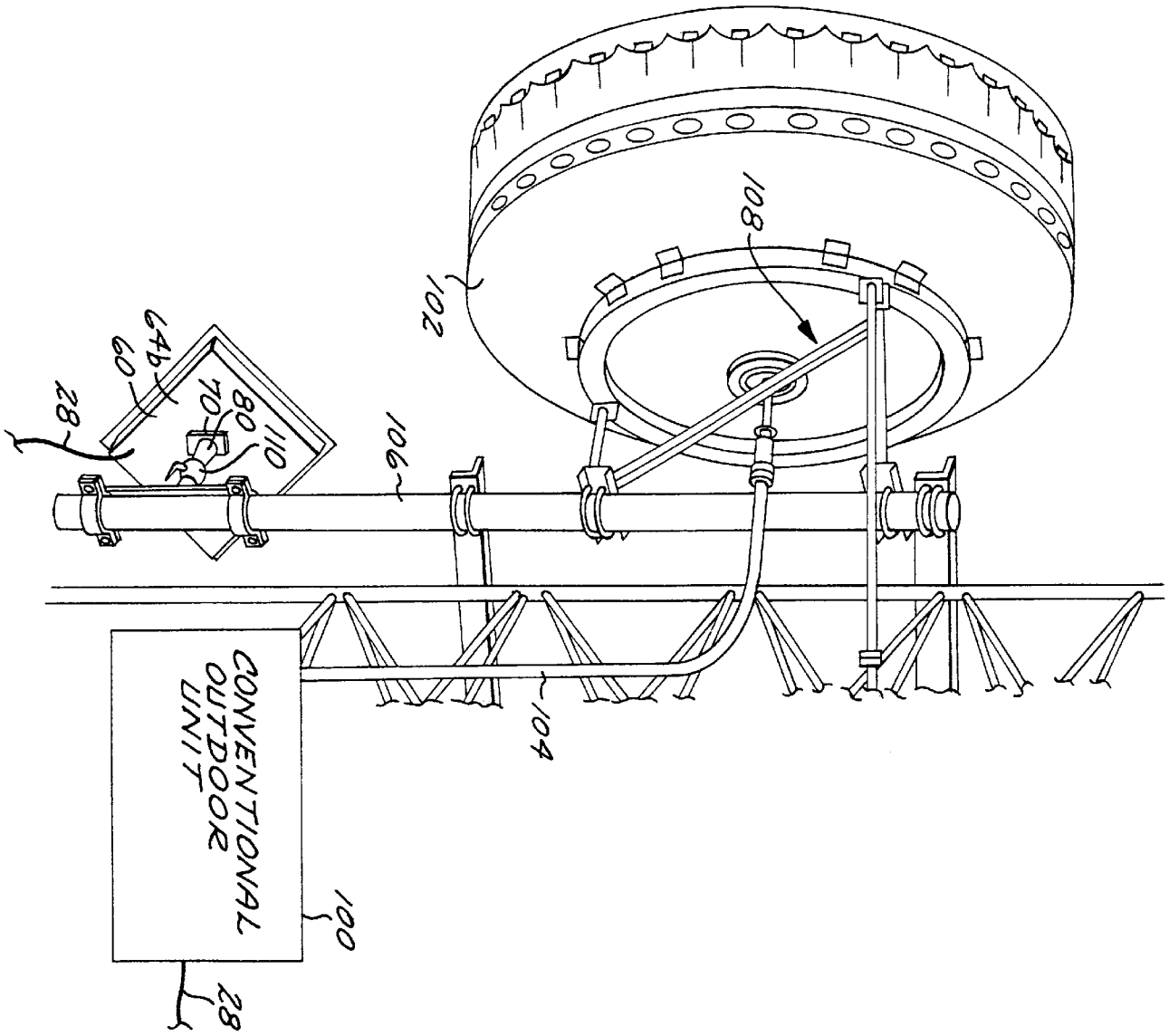
FIG. 9 is a schematic perspective view of a conventional radio frequency unit and antenna and an integrated radio frequency unit/antenna mounted to a mast.

FIG. 9, which is schematic and not drawn to scale, illustrates the mounting of a conventional radio frequency unit 100 and its antenna 102, connected by their microwave feed 104, on a mast 106. The antenna 102 is affixed to the mast by a combination of brackets, struts, and guy wires (collectively, support 108) whose positions may be adjusted by turnbuckles, adjustment screws, or the like. Alignment is relatively difficult. The support approach does not permit easy locking of the antenna to the mast, as with the present approach. Moreover, if the antenna must be replaced for any reason, the support structure must be disassembled to such a degree that a complete realignment of the replacement antenna is usually necessary.

Figure 10:
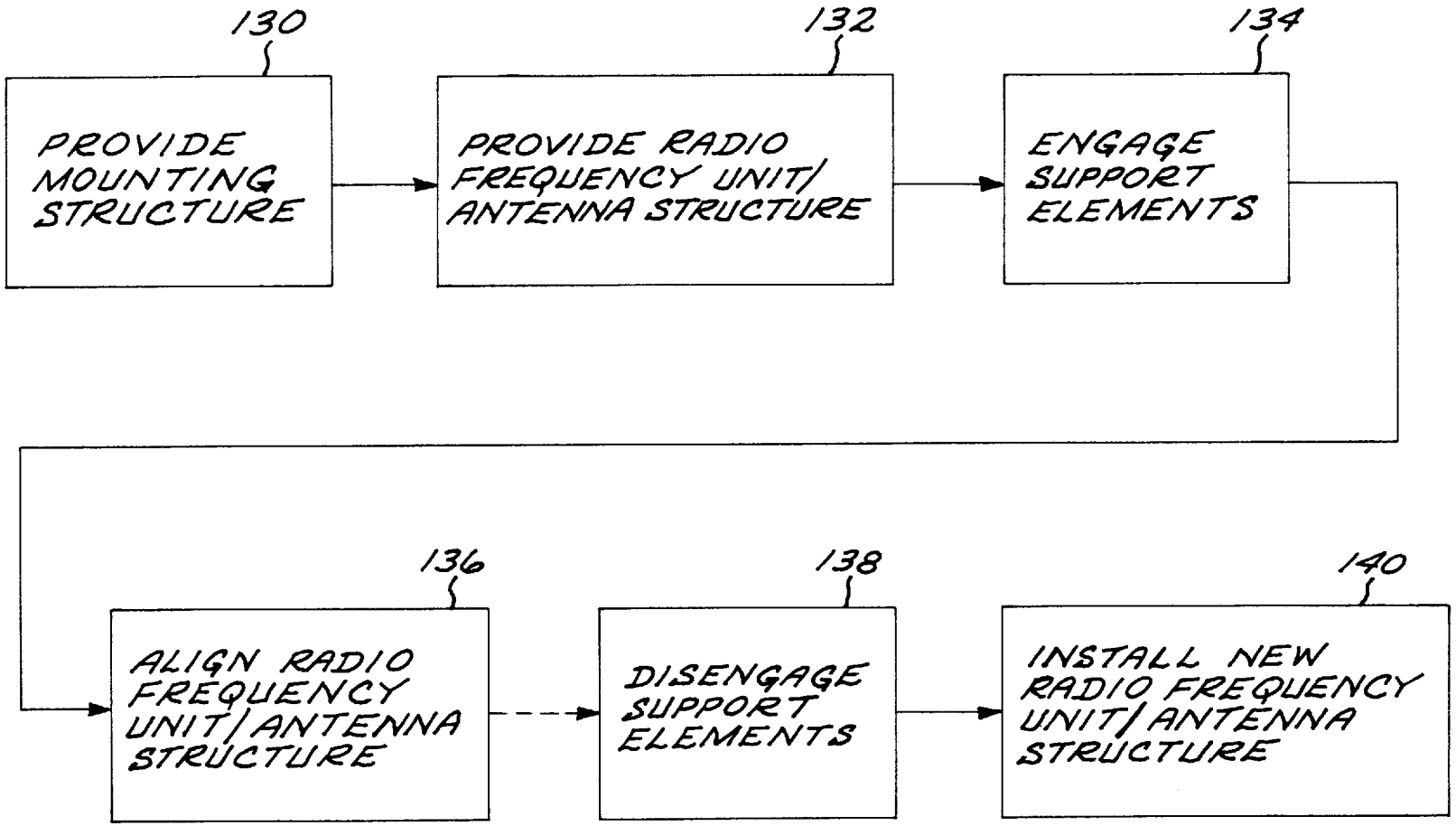
FIG. 10 is a block flow diagram for a method of utilizing the mounting approach according to the invention.

Also shown in FIG. 9 is an integrated radio frequency unit/antenna 60 of the invention and its support 70, and FIG. 10 illustrates a preferred use of the structure. The mounting structure is provided, numeral 130, and the radio frequency unit/antenna is provided, numeral 132. The female dovetail fitting 80 is affixed to the mounting structure mast 106 using an angularly adjustable arm 110 or other support element whose angular position is adjustable during the alignment of the antenna toward the remote antenna. The male dovetail fitting 74 is engaged into the female dovetail fitting 80 to the correct position and the set screw 84 is tightened, numeral 134. The radio frequency unit/antenna 60 is aligned with the corresponding remote unit by changing the angular orientation of the arm 110 until the signal strength transmitted between the two antennas is maximized, numeral 136. The initial alignment of the radio frequency unit/antenna 60 may be viewed as establishing the angular orientation of the reference plane 83*b*, which is thereafter not changed.

If the integrated radio frequency unit/antenna 60 must later be replaced, the lock (if any) is removed, the set screw is loosened, and the dovetail fittings 74 and 80 are slidably disengaged, numeral 138. A new integrated radio frequency unit/antenna 60 is provided and installed, numeral 140, by slidably engaging its dovetail fitting 74 to the dovetail fitting 80 whose position has not been changed by the removal of the old integrated radio frequency unit/antenna 60, setting the set screw, and reinstalling the lock (if any). During this installation, the reference plane surface 83*a* of the replacement unit is brought into closely facing contact with the reference plane surface 83*b*, which is already aligned relative to the remote terminal. Realignment of the replacement radio frequency unit/antenna is therefore typically not required. By contrast, to replace the conventional antenna 100, the support structure 108 must be disassembled and replaced, and the entire antenna must be realigned.

The support approach of the invention has been reduced to practice with a prototype integrated radio frequency unit/antenna 60 for operation at a microwave frequency of 37–40 GHz, as shown in FIG. 3A. The flat antenna has a width W of about 10–½ inches, a length L of about 10–½ inches, and a thickness $T_A$ of about 1 inch. The remaining components, the microwave transceiver 40, controller 42, and power supply 44 fit into a housing having the same length and width, and a thickness $T_B$ of about 2 inches. The total size of the housing and antenna package is about 12 inches by 12 inches by 3 inches. The weight of the integrated radio frequency unit/antenna 60 is about 13 pounds. It is highly desirable that this weight be less than about 15 pounds, as larger weights become much more difficult for personnel to carry to exposed mounting locations. The support approach described herein is fully satisfactory for mounting this device.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An integrated point-to-point microwave radio frequency unit/antenna operable in conjunction with a mounting structure having a mounting structure reference plane surface and a mounting structure support element, comprising:

a housing having a front face and a back face, the back face having a housing reference plane surface thereon;

a microwave radio frequency transceiver electronics package within the housing, the electronics package having an external connection and an antenna connection;

an antenna affixed to the front face of the housing;

a microwave radio frequency feed communicating between the antenna and the antenna connection of the microwave transceiver electronics package; and a housing support element affixed to the housing, the housing support element and the mounting structure support element being engageable to each other such that the housing reference plane surface is positioned in contact with the mounting structure reference plane surface in a face-to-face relationship.

2. The radio frequency unit/antenna of claim 1, further including the mounting structure.

3. The radio frequency unit/antenna of claim 2, further including a lock extending between the housing support element and the mounting structure.

4. The radio frequency unit/antenna of claim 1, wherein the housing is a rectangular prism in exterior shape.

5. The radio frequency unit/antenna of claim 1, wherein the housing, the electronics package, the antenna, and the radio frequency feed, and the housing support element together have a weight of no more than about 15 pounds.

6. The radio frequency unit/antenna of claim 1, wherein the housing support element includes a first portion of a dovetail support.

7. The radio frequency unit/antenna of claim 6, wherein the first portion of the dovetail support comprises a male dovetail fitting.

8. The radio frequency unit/antenna of claim 7, further including the mounting structure having the mounting structure support element, the mounting structure support element comprising a female dovetail fitting sized to receive the male dovetail fitting therein.

9. The radio frequency unit/antenna of claim 8, further including a lock extending between the first portion of the dovetail support and the mounting structure.

10. An integrated point-to-point microwave radio frequency unit/antenna, comprising:

a housing having a front face and a back face;

a microwave radio frequency transceiver electronics package within the housing, the electronics package having an external connection and an antenna connection;

an antenna affixed to the front face of the housing;

a microwave radio frequency feed communicating between the antenna and the antenna connection of the microwave transceiver electronics package; and a first portion of a dovetail fitting affixed to the back face of the housing.

11. The radio frequency unit/antenna of claim 10, further including a mounting structure having thereon a second portion of a dovetail fitting dimensioned to receive the first portion of the dovetail fitting therein.

12. The radio frequency unit/antenna of claim 11, further including a lock extending between the first portion of the dovetail fitting and the second portion of the dovetail fitting.

13. The radio frequency unit/antenna of claim 11, further including an engagement extending between the first portion of the dovetail fitting and the second portion of the dovetail fitting.

14. The radio frequency unit/antenna of claim 13, wherein the engagement includes a set screw in at least one of the first portion of the dovetail fitting and the second portion of the dovetail fitting, the set screw being position to set against the other of the portions of the dovetail fittings.

15. The radio frequency unit/antenna of claim 11, wherein the back face of the housing includes a housing reference plane surface thereon and the mounting structure includes a mounting structure reference plane surface thereon, and wherein an engagement between the first portion of the dovetail fitting and the second portion of the dovetail fitting places the housing reference plane surface and the mounting structure reference plane surface into facing contact.

16. A method for mounting a radio frequency unit/antenna, comprising the steps of providing a mounting structure having a mounting structure reference plane surface and a mounting structure support element;

providing a radio frequency unit/antenna, comprising a housing having a front face and a back face, the back face having a housing reference plane surface thereon, a microwave radio frequency transceiver electronics package within the housing, the electronics package having an external connection and an antenna connection, an antenna affixed to the front face of the housing, a microwave radio frequency feed communicating between the antenna and the antenna connection of the microwave transceiver electronics package, and a housing support element affixed to the housing;

engaging the housing support element and the mounting structure support element to each other such that the housing reference plane surface is positioned in contact with the mounting structure reference plane surface in a face-to-face relationship.

17. The method of claim 16, including the additional steps, after the step of engaging, disengaging the housing support element from the mounting structure support element to remove the radio frequency unit/antenna;

providing a second radio frequency unit/antenna having substantially the same structure as the radio frequency unit/antenna;

engaging a housing support element of the second radio frequency unit/antenna and the mounting structure support element to each other such that the a housing reference plane surface of the second radio frequency unit/antenna is positioned in contact with the mounting structure reference plane surface in a face-to-face relationship.

18. The radio frequency unit/antenna of claim 1, wherein the microwave radio frequency transceiver electronics package comprises a microwave transceiver.

19. The radio frequency unit/antenna of claim 1, wherein the antenna is a flat antenna.

20. The radio frequency unit/antenna of claim 10, wherein the first portion of the dovetail fitting comprises a male dovetail fitting having a tenon thereon.

21. The radio frequency unit/antenna of claim 10, wherein the microwave radio frequency transceiver electronics package comprises a microwave transceiver.

22. The radio frequency unit/antenna of claim 10, wherein the antenna is a flat antenna.

23. The method of claim 16, wherein the microwave radio frequency transceiver electronics package comprises a microwave transceiver.

24. The method of claim 16, wherein the antenna is a flat antenna.

25. The method of claim 16, wherein the mounting structure support element comprises a first portion of a dovetail fitting, and the housing support element comprises a second portion of the dovetail fitting.

* * * * *

UNITED STATES PATENT AND TRADEMARK OFFICE

CERTIFICATE OF CORRRECTION

PATENT NO. : 5,864,321
DATED : January 26, 1999
INVENTOR(S) : Jeffrey A. Paul, et al.

It is certified that error appears in the above-identified patent and that said Letters Patent is hereby corrected as shown below:

On the title page, item 56 add the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 5 | 0 | 6 | 0 | 8 | 9 | 8 | 10/29/91 | Wen-Shyong Chang | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | NAME | CLASS | SUBCLASS | TRANSLATION YES | TRANSLATION NO |
|---|---|---|---|---|---|---|---|---|---|---|---|---|---|---|
| | DE | 2 | 7 | 2 | 4 | 1 | 3 | 0A | 30-11-1978 | Siemens AG | | | | |
| | WO | 9 | 5 | 2 | 5 | 3 | 8 | 7 | 21-08-1995 | Fujitsu Ltd. et al. | | | | |
| | GB | 2 | 2 | 0 | 7 | 5 | 5 | 7A | 01-02-1989 | Leader Radio Co., Ltd. | | | | |
| | JP | 0 | 9 | 0 | 5 | 1 | 2 | 12A | 30-06-1997 | Fujitsu General Ltd. | | | | |
| | JP | 0 | 9 | 0 | 5 | 1 | 2 | 15A | 30-06-1997 | Fujitsu General Ltd. | | | | |
| | | | | | | | | | | | | | | |
| | | | | | | | | | | | | | | |
| | | | | | | | | | | | | | | |

Signed and Sealed this

Nineteenth Day of October, 1999

*Attest:*

Q. TODD DICKINSON

*Attesting Officer*

*Acting Commissioner of Patents and Trademarks*